US009609413B2

(12) United States Patent
Hsiao

(10) Patent No.: US 9,609,413 B2
(45) Date of Patent: Mar. 28, 2017

(54) HEADPHONE

(71) Applicant: SEA TRADE ELECTRONIC (SHENZHEN) CO., LTD, Shenzhen, Guangdong (CN)

(72) Inventor: Ko-Fei Hsiao, Guangdong (CN)

(73) Assignee: SEA TRADE ELECTRONICS (SHENZHEN) CO., LTD, Shenzhen (CN)

( * ) Notice: Subject to any disclaimer, the term of this patent is extended or adjusted under 35 U.S.C. 154(b) by 0 days.

(21) Appl. No.: 14/963,229

(22) Filed: Dec. 8, 2015

(65) Prior Publication Data

US 2016/0192061 A1 Jun. 30, 2016

Related U.S. Application Data

(63) Continuation-in-part of application No. PCT/CN2015/070819, filed on Jan. 16, 2015.

(30) Foreign Application Priority Data

Dec. 31, 2014 (CN) ..... 2014 1 0854747

(51) Int. Cl.
*H04R 1/10* (2006.01)

(52) U.S. Cl.
CPC ..... *H04R 1/1008* (2013.01); *H04R 1/1016* (2013.01); *H04R 1/1066* (2013.01)

(58) Field of Classification Search
CPC .... H04R 1/10; H04R 2205/022; H04R 1/105; H04R 5/0335; H04R 2201/10; H04R 2460/13; H04R 1/1016
(Continued)

(56) References Cited

U.S. PATENT DOCUMENTS 1,747,778 A * 2/1930 Kuchenmeister ..... H04R 1/10 381/370
2,681,389 A * 6/1954 Shaper ..... H04R 11/00 381/378

(Continued)

FOREIGN PATENT DOCUMENTS

CN 102595266 A 7/2012
CN 203522995 U 4/2014
WO 9319562 A1 9/1993

OTHER PUBLICATIONS

International Search Report of PCT Patent Application No. PCT/CN2015/070819 issued on Sep. 25, 2015.

*Primary Examiner* — Suhan Ni

(57) ABSTRACT

Disclosed is a headphone, which includes a flexible inverted U-shape headband, a first headphone unit provided on an end of the headband and a second headphone unit provided on the other end of the headband. The first headphone unit is a circumaural headphone unit and the second headphone unit is an in-ear headphone unit. When using the above headphone, one ear of user is covered with the first headphone unit and the second headphone unit is put into the other ear of user. Due to the first headphone unit being a circumaural headphone unit and the second headphone unit being an in-ear headphone unit, the second headphone unit could be removed casually, which is easy to use. And such a headphone structure is novel and easy to be recognized. In addition, the unsymmetrical configuration of the headphone of the present invention can satisfy the market demand on new type headphone.

2 Claims, 7 Drawing Sheets

(58) Field of Classification Search
USPC ..... 381/370–371, 374, 377–378, 380
See application file for complete search history.

(56) References Cited

U.S. PATENT DOCUMENTS

| | | | | |
|---|---|---|---|---|
| 6,130,953 | A * | 10/2000 | Wilton | H04M 1/05 381/377 |
| 6,622,029 | B1 * | 9/2003 | Skulley | H04M 1/05 381/378 |

* cited by examiner

HEADPHONE

CROSS-REFERENCE TO RELATED APPLICATIONS

The present application is a Continuation-In-Part Application of PCT application No. PCT/CN2015/070819 filed on Jan. 16, 2015, which claims the benefit of Chinese Patent Application No. 201410854747.3, filed on Dec. 31, 2014, the contents of which are hereby incorporated by reference.

FIELD OF THE INVENTION

The present invention relates to earphones, and more particularly to a headphone.

BACKGROUND OF THE INVENTION

Headphone is a common sound-electronic transducer of digital products. With advances in technology, the user demand on the type of headphones is increased and the expectation of new type of headphone is raised. These user demands have brought new challenges to the headphone industry. At present, the greatest concern of the user is sound quality and construction of the headphones. Thus, the improvement of the headphone structure will attract the eyes of the user in the future. The existing headphone generally has a structure which is bilaterally symmetrical and such a traditional structure and appearance is hard to be recognized by the consumers among kinds of headphone in market. Additionally, during the use of such a headphone, if the user wants to talk with others, the whole headphone must be removed from the head of user, which make it annoying to use. In view of the above, it is necessary to provide a new type headphone to meet market demand.

SUMMARY OF THE INVENTION

One object of the present invention is to provide a new type headphone, which has unsymmetrical structure, is easy to use and easy to be recognized, so as to overcome the defects of the prior art.

To achieve above objects, there is provided a technical solution as follows:

A headphone, which includes a flexible inverted U-shape headband, a first headphone unit provided on an end of the headband and a second headphone unit provided on the other end of the headband. The first headphone unit is a circumaural headphone unit and the second headphone unit is an in-ear headphone unit.

Preferably, the first headphone unit includes a bowl-shaped first shell, a first support provided on an opening of the first shell, a first speaker unit fixed on the first support and an elastic ear-shield provided on the first support and surrounding the first speaker unit.

Preferably, the second headphone unit comprises a bowl-shaped second shell, a second support provided on an opening of the second shell and having sound holes formed thereon, a second speaker unit fixed inside the second shell and facing to the sound holes, and a flexible mesh enclosure having a convex structure and mounted at outer side of the second support.

Preferably, the second headphone unit comprises a bowl-shaped second shell, a second support provided on an opening of the second shell and having a sound hole formed thereon, a second speaker unit fixed inside the second shell and facing to the sound hole, and an elastic earplug provided on the second support and surrounding the sound hole.

Preferably, the second shell is connected with the headband via a spiral cable.

According to the headphone of the present invention, when using, one ear of user is covered with the first headphone unit and the second headphone unit is put into the other ear of user. Due to the first headphone unit being a circumaural headphone unit and the second headphone unit being an in-ear headphone unit, the second headphone unit could be removed casually when using, which is easy to use for user. And such a headphone structure is more novel and easy to be recognized. In addition, the unsymmetrical configuration of the headphone of the present invention can satisfy the market demand on new type headphone.

DETAILED DESCRIPTION OF ILLUSTRATED EMBODIMENTS

Some embodiments of the present invention will be described as follows, by way of example only, with reference to the accompanying drawings.

The First Embodiment

Figure 1:
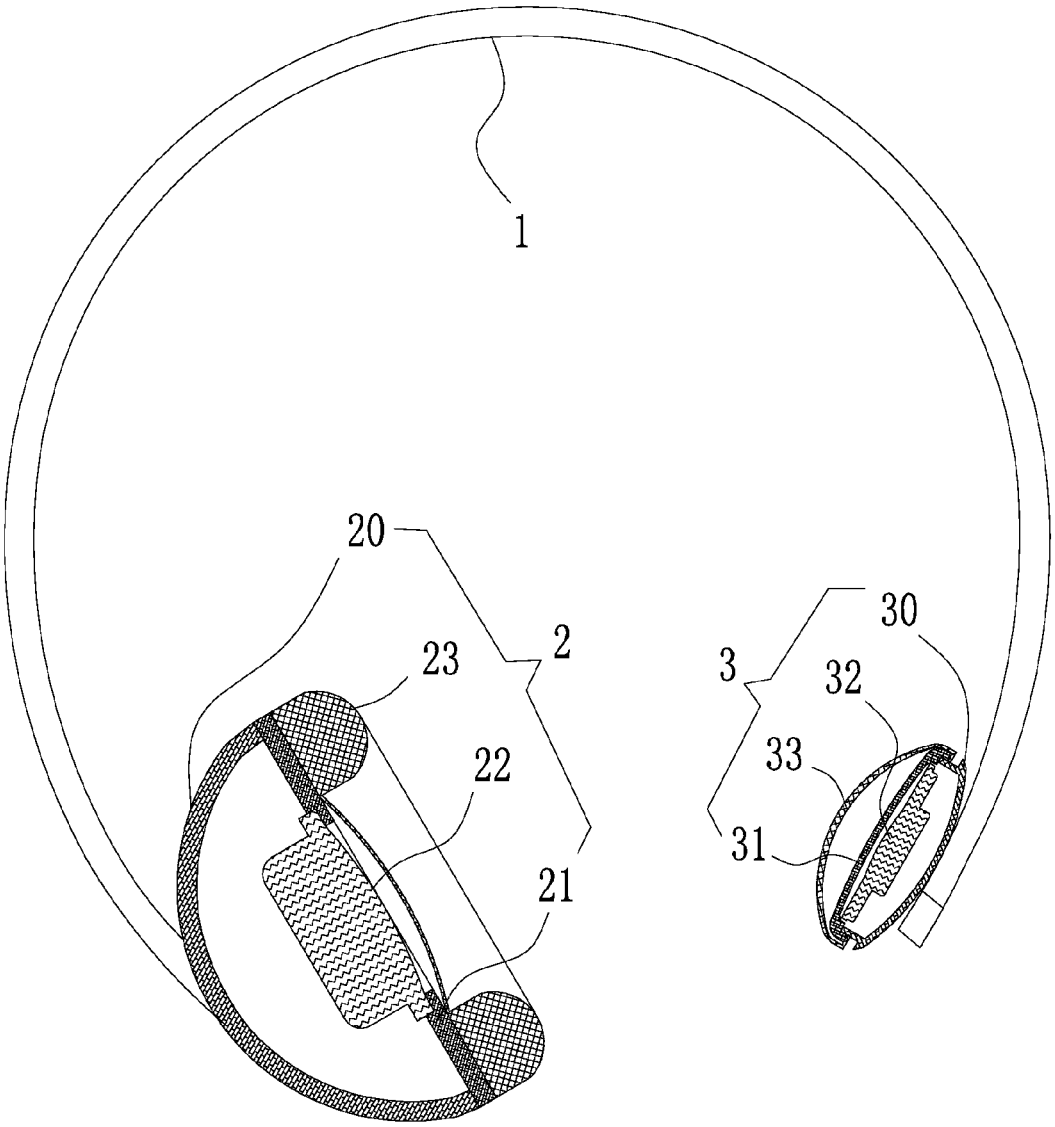
FIG. 1 is a section view of a headphone according to a first embodiment of the present invention.
Figure 2:
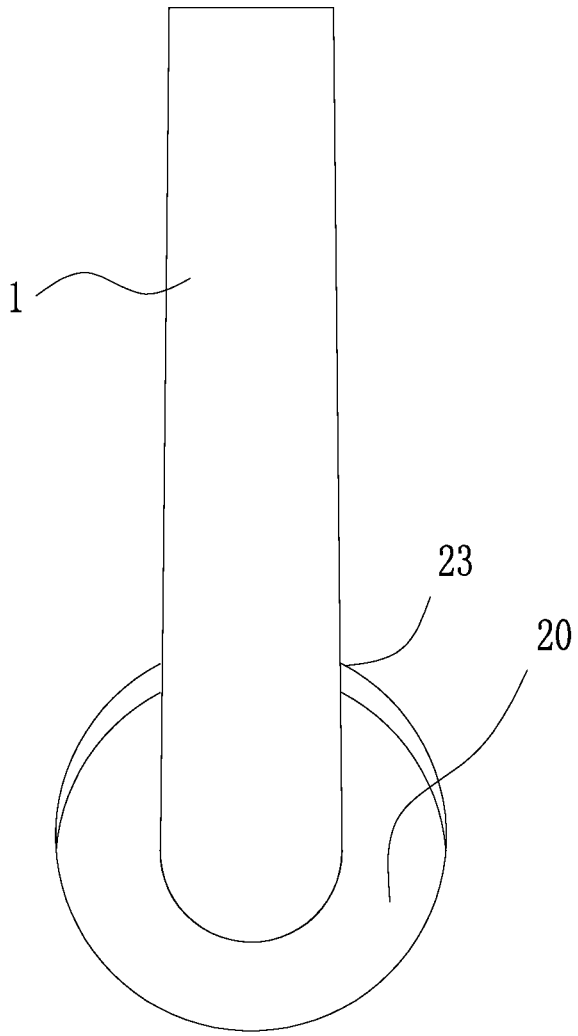
FIG. 2 is a side elevational view of a first headphone unit according to the first embodiment of the present invention.
Figure 3:
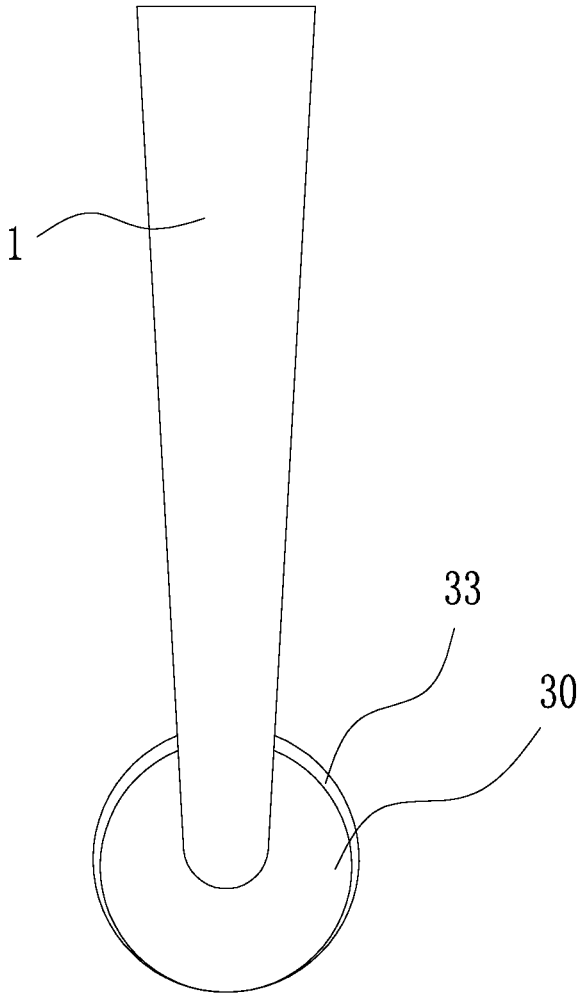
FIG. 3 is a side elevational view of a second headphone unit according to the first embodiment of the present invention.

As shown from FIG. 1 to FIG. 3, according to the first embodiment of the present invention, the headphone includes headband 1, which is a flexible inverted U-shape support. There is a first headphone unit 2 provided on an end of the headband 1 and a second headphone unit 3 provided on the other end of the headband 1. The first headphone unit 2 is a circumaural headphone unit and the second headphone unit 3 is an in-ear headphone unit.

When using the above headphone, one ear of user is covered with the first headphone unit 2 and the second headphone unit 3 is put into the other ear of user. Due to the first headphone unit 2 being a circumaural headphone unit and the second headphone unit 3 being an in-ear headphone unit, the second headphone unit 3 could be removed casually when using, which is easy to use for user. And such a headphone structure is more novel and easy to recognize. In addition, the unsymmetrical configuration of the headphone of the present invention can satisfy the market demand on new type headphone.

As a preferred embodiment, the first headphone unit 2 includes a bowl-shaped first shell 20, a first support 21 provided on an opening of the first shell 20, a first speaker unit 22 fixed on the first support 21 and an elastic ear-shield 23 provided on the first support 21 and surrounding the first speaker unit 22.

According to this embodiment, the second headphone unit 3 includes a bowl-shaped second shell 30, a second support 31 provided on an opening of the second shell 30 and having sound holes formed thereon, a second speaker unit 32 fixed inside the second shell 32 and facing to the sound holes, and a flexible mesh enclosure 33 having a convex structure and mounted at outer side of the second support 31. The second headphone unit 3 is a supra-aural headphone unit, which can be put into the auricle of user, and it is provided to form an unsymmetrical configuration together with the first headphone unit 2.

The Second Embodiment

Figure 4:
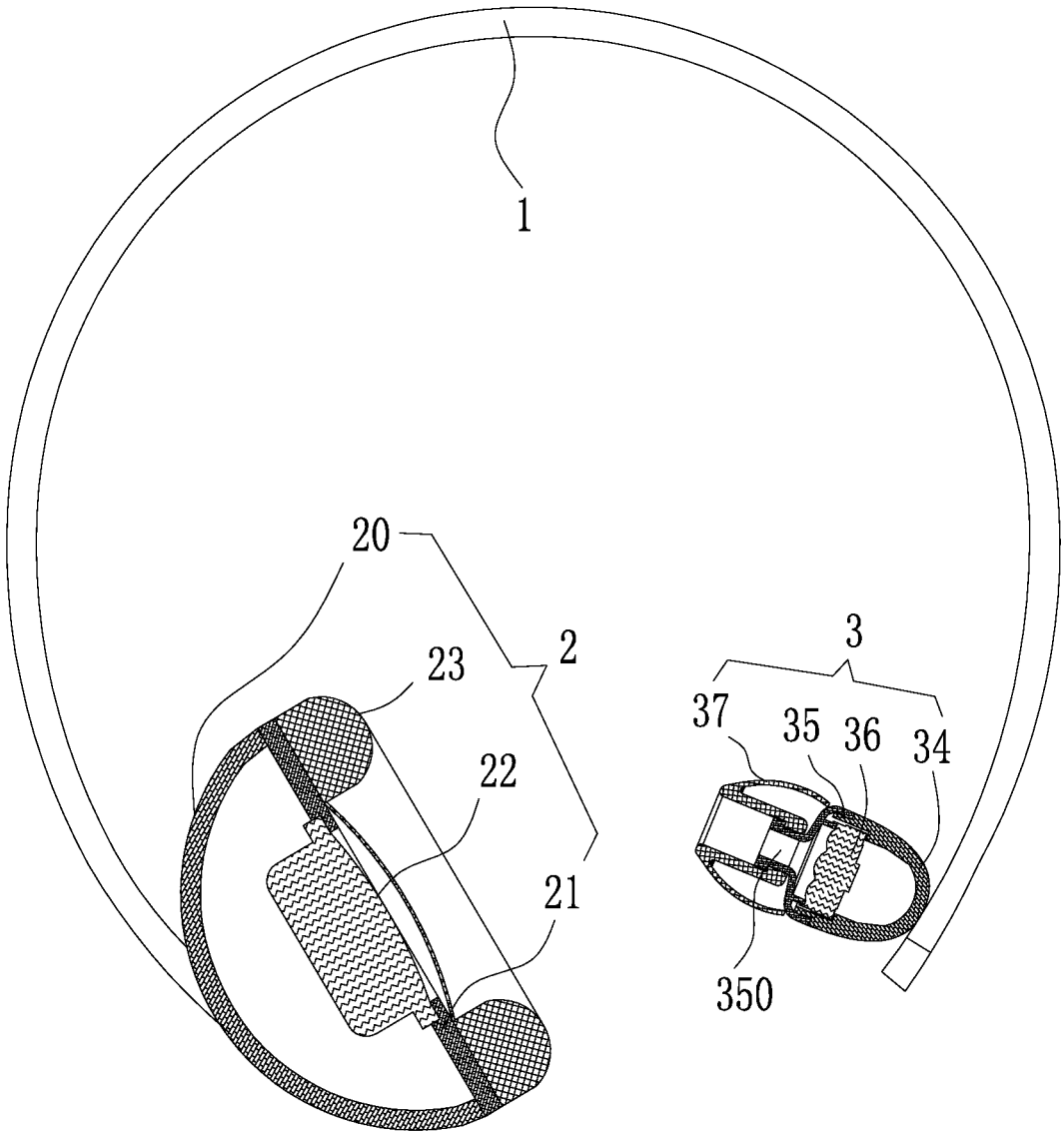
FIG. 4 is a section view of a headphone according to a second embodiment of the present invention.
Figure 5:
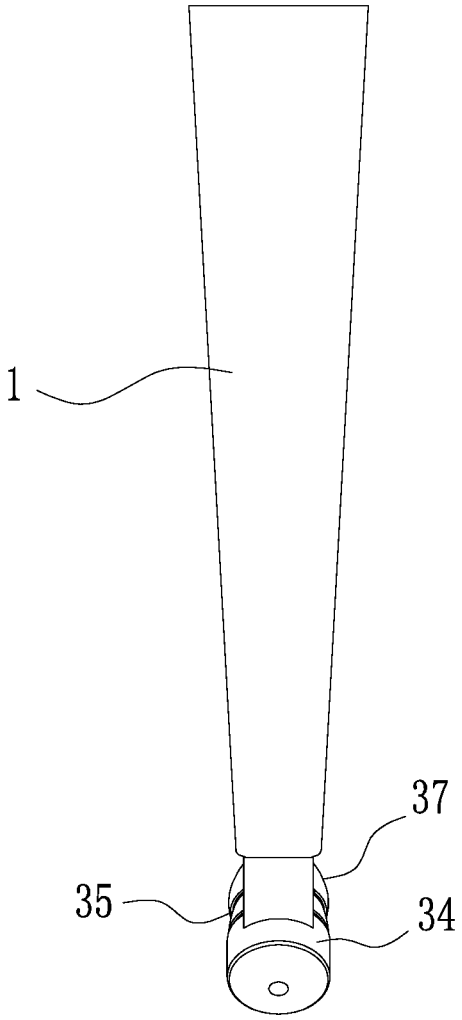
FIG. 5 is a side elevational view of a second headphone unit according to the second embodiment of the present invention.

As shown in FIG. 4 and FIG. 5, according to the second embodiment of the present invention, the headphone includes headband 1, which is a flexible inverted U-shape support. There is a first headphone unit 2 provided on an end of the headband 1 and a second headphone unit 3 provided on the other end of the headband 1. The first headphone unit 2 is a circumaural headphone unit and the second headphone unit 3 is an in-ear headphone unit.

As a preferred embodiment, the first headphone unit 2 includes a bowl-shaped first shell 20, a first support 21 provided on an opening of the first shell 20, a first speaker unit 22 fixed on the first support 21 and an elastic ear-shield 23 provided on the first support 21 and surrounding the first speaker unit 22.

Compared with the first embodiment, the second embodiment has a different second headphone unit 3 as follows: the second headphone unit 3 includes a bowl-shaped second shell 34, a second support 35 provided on an opening of the second shell 34 and having a sound hole 350 formed thereon, a second speaker unit 36 fixed inside the second shell 34 and facing to the sound hole 350, and an elastic earplug 37 provided on the second support 35 and surrounding the sound hole 35. The second headphone unit 3 is an earplug type headphone unit, which can be put into the ear canal of user and be removed casually when using and it is provided to form an unsymmetrical configuration together with the first headphone unit 2.

The Third Embodiment

Figure 6:
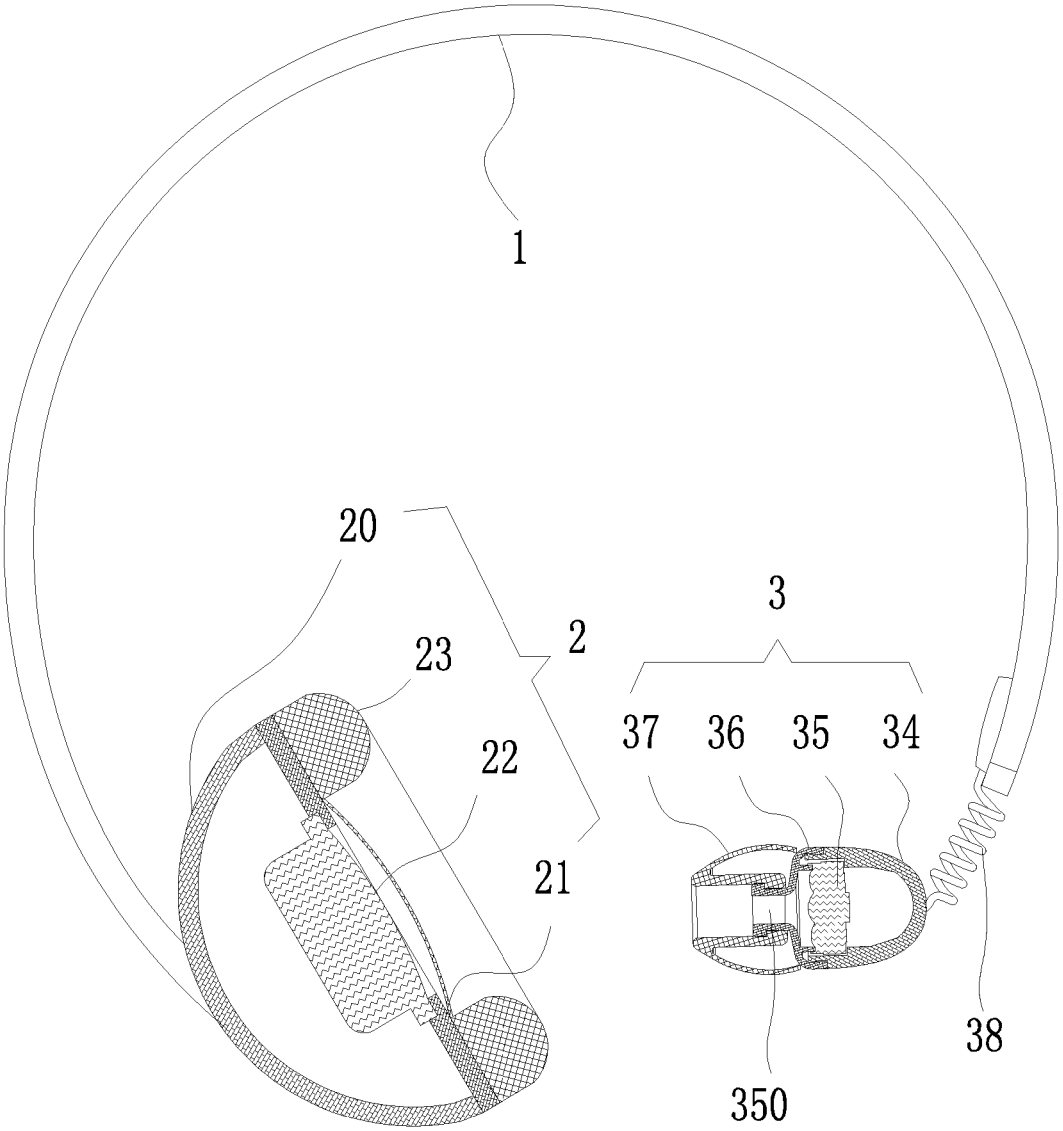
FIG. 6 is a section view of a headphone according to a third embodiment of the present invention.
Figure 7:
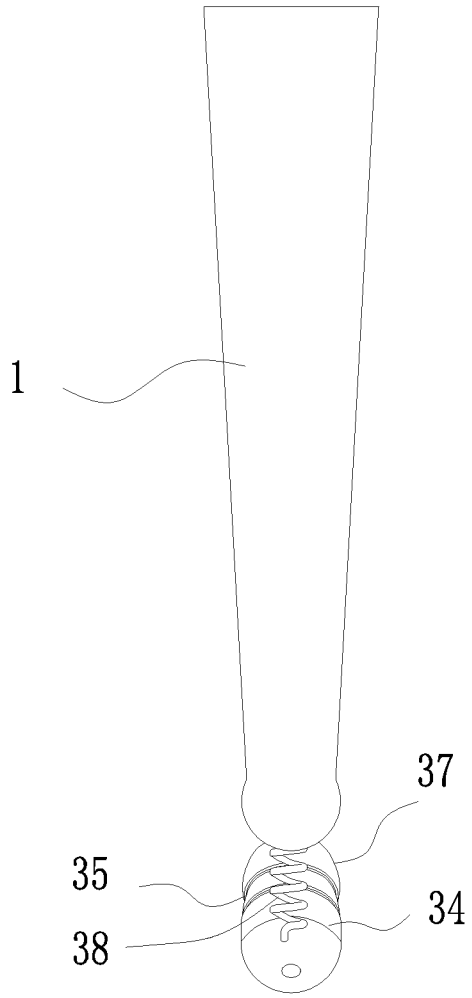
FIG. 7 is a side elevational view of a second headphone unit according to the third embodiment of the present invention.

As shown in FIG. 6 and FIG. 7, according to the third embodiment of the present invention, it has similar structure to that of the second embodiment and the only difference is as follows: in the third embodiment, the second shell 34 of the second headphone unit 3 is connected with the headband 1 via a spiral cable 38 so that the second headphone unit 3 can be put into the ear canal of user more easily and be removed casually when using.

According to the headphone of the present invention, it has an unsymmetrical configuration formed by two different headphone units so as to provide a new design of structure and appearance. Among kinds of headphone in market, this headphone of the present invention can be recognized by the consumers, thus it can satisfy the market demand on new type headphone. In a practical application, the sound pressure and tone quality of the two headphone units can be adjusted to be a balanced state, thereby achieving a desired auditory effect.

Above descriptions of embodiments are provided for further illustrating the technical content of the present invention, so as to facilitate understanding and it should be understood that the invention is not to be limited to the disclosed embodiments. Any technique extension and recreation according to the present invention should be included within the scope of protection of the invention.

What is claimed is:

1. A headphone, comprising a flexible inverted U-shape headband, a first headphone unit provided on an end of the headband and a second headphone unit provided on an other end of the headband, wherein the first headphone unit is a circumaural headphone unit and the second headphone unit is an in-ear headphone unit;

wherein the second headphone unit comprises a bowl-shaped second shell, a second support provided on an opening of the second shell and having a sound hole formed thereon, a second speaker unit fixed inside the second shell and facing to the sound hole, and an elastic earplug provided on the second support and surrounding the sound hole; and the second shell is connected with the headband via a spiral cable.

2. The headphone according to claim 1, wherein the first headphone unit comprises a bowl-shaped first shell, a first support provided on an opening of the first shell, a first speaker unit fixed on the first support and an elastic ear-shield provided on the first support and surrounding the first speaker unit.

* * * * *